US005933803A

United States Patent [19]

Ojala

[11] Patent Number: 5,933,803

[45] Date of Patent: Aug. 3, 1999

[54] SPEECH ENCODING AT VARIABLE BIT RATE

[75] Inventor: Pasi Ojala, Lempäälä, Finland

[73] Assignee: Nokia Mobile Phones Limited, Espoo, Finland

[21] Appl. No.: 08/986,110

[22] Filed: Dec. 5, 1997

[30] Foreign Application Priority Data

Dec. 12, 1996 [FI] Finland ..... 964975

[51] Int. Cl.[6] ..... G10L 9/00

[52] U.S. Cl. ..... 704/223; 704/221; 704/219; 704/228; 704/216

[58] Field of Search ..... 704/223, 219, 704/207, 230, 211, 228, 222, 216, 221

[56] References Cited

U.S. PATENT DOCUMENTS

| | | | |
|---|---|---|---|
| 4,868,867 | 9/1989 | Davidson et al. | 704/219 |
| 4,890,328 | 12/1989 | Prezas | 704/216 |
| 4,969,192 | 11/1990 | Chen et al. | 381/31 |
| 5,091,945 | 2/1992 | Kleijn | 704/222 |
| 5,233,660 | 8/1993 | Chen | 704/223 |
| 5,265,167 | 11/1993 | Akamine et al. | 704/223 |
| 5,307,441 | 4/1994 | Tzeng | 704/222 |
| 5,327,520 | 7/1994 | Chen | 704/219 |
| 5,414,796 | 5/1995 | Jacobs et al. | 704/221 |
| 5,444,816 | 8/1995 | Adoul et al. | 395/2.28 |
| 5,483,668 | 1/1996 | Malkamaki et al. | 455/33.2 |
| 5,553,191 | 9/1996 | Minde | 704/219 |
| 5,579,433 | 11/1996 | Jarvinen | 395/228 |

FOREIGN PATENT DOCUMENTS

| | | |
|---|---|---|
| 0449043 A3 | 10/1991 | European Pat. Off. . |
| WO 95/28824 | 11/1995 | WIPO . |
| WO 96/05592 | 2/1996 | WIPO . |

OTHER PUBLICATIONS

Peter Kroon & Bishnu S. Atal, "Pitch Predictors with High Temporal Resolution", Proc. of ICASSP–90, pp. 661–664.

ETSI GSM 06.60 version 5.1.2, Mar. 1997.

*Primary Examiner*—David R. Hudspeth
*Assistant Examiner*—Vijay B. Chawan
*Attorney, Agent, or Firm*—Perman & Green, LLP

[57] ABSTRACT

The invention is related digital speech encoding. In a speech codec according to the invention, for modeling a speech signal (301) both prediction parameters (321, 322, 331) modeling a speech signal in a short term and prediction parameters (341, 342, 351) modeling a speech signal in a long term are used. Each prediction parameter (321, 322, 331, 341, 342, 351) is presented using a certain accuracy, in a digital system with a certain number of bits. In speech encoding according to the invention the number of bits used for presenting prediction parameters (321, 322, 331, 341, 342, 351) is adjusted based upon information parameters (321, 322, 331, 341, 342, 351) obtained from a short-term LPC-analysis (32) and from a long-term LTP-analysis (31, 34, 35). The invention is particularly suitable for use at low data transfer speeds, because it offers a speech encoding method of even quality and low average bit rate.

9 Claims, 11 Drawing Sheets

SPEECH ENCODING AT VARIABLE BIT RATE

FIELD OF THE INVENTION

The present invention relates particularly to a digital speech codec operating at a variable bit rate, in which codec the number of bits used for speech encoding can vary between subsequent speech frames. The parameters used at speech synthesis and their presentation accuracy are selected according to current operating situation. The invention is also related to a speech codec operating at a fixed bit rate in which the length (number of bits) of various types of excitation parameters utilized for modelling speech frames is adjusted in relation to each other within speech frames of standard length.

BACKGROUND OF THE INVENTION

In the modern information society data in a digital form, such as speech, is transferred in an increasing volume. A great share of this information is transferred utilizing wireless telecommunication connections, as e.g. in various mobile communication systems. It is in particular here that high requirements are set to the efficiency of data transfer in order to utilize the limited number of radio frequencies as efficiently as possible. In addition to this, in connection with new services a simultaneous need for both a higher data transfer capacity and a better voice quality is present. In order to achieve these targets different encoding algorithms are developed continuously, with the aim to reduce the average number of bits of a data transfer connection without compromising the standard of the services offered. In general this target is striven for according to two basic principles: either by trying to make fixed line speed encoding algorithms more efficient or by developing encoding algorithms utilizing variable line speed.

The relative efficiency of a speech codec operating a variable bit rate is based upon the fact that speech is variable in character, in other words, a speech signal contains a different amount of information at different times. If a speech signal is divided into speech frames of standard length (e.g. 20 ms) and each of them is encoded separately, the number of bits used for modelling each speech frame can be adjusted. In this way speech frames containing a small amount of information can be modelled using a lower number of bits than speech frames containing plenty of information. In this case it is possible to keep the average bit rate lower than in speed codecs utilizing fixed line speed and maintain the same subjective voice quality.

Encoding algorithms based upon variable bit rate can be utilized in various ways. Packet networks, such as e.g. Internet and ATM (Asynchronous Transfer Mode)-networks, are well suited for variable bit rate speech codecs. The network provides the data transfer capacity currently required by the speech codec by adjusting the length and/or transmission frequency of the data packets to be transferred in the data transfer connection. Speech codecs using variable bit rate are also well suited for digital recording of speech in e.g. telephone answering machines and speech mail services.

It is possible to adjust the bit rate of a speech codec operating at a variable bit rate in a number of ways. In generally known variable rate speech codecs the transmitter bit rate is decided already before the encoding of the signal to be transmitted. This is the procedure e.g. in connection with the speech codec of QCELP-type used in the CDMA (Code Division Multiple Access) mobile communication system prior known to a person skilled in the art, in which system certain predetermined bit rates are available for speech encoding. These solutions however only have a limited number of different bit rates, typically two speeds for a speech signal, e.g. full speed (1/1) and half speed (1/2) encoding) and a separate, low bit rate for background noise (e.g. 1/8-speed). Patent publication WO 9605592 A1 presents a method in which input signal is divided into frequency bands and the required encoding bit rate is assessed for each frequency band based upon the energy contents of the frequency band. The final decision upon the encoding speed (bit rate) to be used is made based upon these frequency band specific bit rate decisions. Another method is to adjust the bit rate as a function of the available data transfer capacity. This means that any current bit rate to be used is selected based upon the fact how much data transfer capacity is available. This kind of procedure results in reduced voice quality when the telecommunication network is heavily loaded (the number of bits available for speech encoding is limited). On the other hand the procedure unnecessarily loads the data transfer connection at moments which are "easy" for speech encoding.

Other methods, prior known to a person skilled in the art, used in variable bit rate speech codecs for adjusting the bit rate of the speech encoder are the detection of to voice activity (VAD, Voice Activity Detection). It is possible to use the detection of voice activity e.g. in connection with a fixed line speed codec. In this case the speech encoder can be entirely switched off when the voice activity detector finds out that the speaker is quiet. The result is the simplest possible speech codec operating at variable line speed.

Speech codecs operating at fixed bit rate, which nowadays are very widely used e.g. in mobile communication systems, are operating at same bit rate independent of the contents of the speech signal. In these speech codecs one is forced to select a compromise bit rate, which on one hand does not waste too much of the data transfer capacity and on the other hand provides a sufficient speech quality even for speech signals which are difficult to encode. With this procedure the bit rate used for speech encoding is always unnecessarily high for so called easy speech frames, the modelling of which could be successfully carried out even by a speech codec with a lower bit rate. In other words, the data transfer channel is not used effectively. Among easy speech frames are e.g. silent moments detected utilizing a speech activity detector (VAD), strongly voiced sounds (resembling sinus-signals, which can successfully be modelled based upon amplitude and frequency) and some of the phoneme resembling noise. Due to the characteristics of the hearing, noise need not be equally accurately modelled, because an ear will not detect small differences between the original and the coded (even if poor) signal. Instead, voiced sections easily mask noise. Voiced sections must be encoded accurately (accurate parameters (plenty of bits) are to be used)), because an ear will hear even small differences in signals.

FIG. 1 presents a typical speech encoder utilizing code-excited linear prediction (CELP, Code Excited Linear Predictor). It comprises several filters used for modelling the speech production. A suitable excitation signal is selected for these filters from an excitation code book containing a number of excitation vectors. A CELP speech encoder typically comprises both short-term and long-term filters, using which it is attempted to synthesize a signal resembling the original speech signal as much as possible. Normally all excitation vectors stored in an excitation code book are checked in order to find the best excitation vector. During the excitation vector search each suitable excitation vector is forwarded to the synthesizing filters, which typically comprise both short-term and long-term filters. The synthesized speech signal is compared with the original speech signal and the excitation vector which produces the signal best corresponding to the original signal is selected. In the selection criterion the ability of human ear to detect different errors is generally utilized, and the excitation vector producing the smallest error signal for each speech frame is selected. The excitation vectors used in a typical CELP-speech encoder have been determined experimentally. When a speech encoder of ACELP-type (Algebraic Code Excited Linear Predictor) is used, the excitation vector consists of a fixed number of pulses different from zero, which pulses are mathematically calculated. In this case an actual excitation code book is not required. The best excitation is obtained by selecting optimal pulse positions and amplitudes using the same error criterion as in above CELP-encoder.

Speech encoders of CELP- and ACELP-types, prior known to a person skilled in the art, use fixed rate excitation calculation. The maximum number of pulses per excitation vector is fixed, as well as the number of different pulse positions within a speech frame. When each pulse is still quantized with fixed accuracy, the number of bits to be generated per each excitation vector is constant regardless of the incoming speech signal. CELP-type codecs use a large number of bits for the quantizing of excitation signals. When high quality speech is generated a relatively large code book of excitation signals is required in order to have access to a sufficient number of different excitation vectors. The codecs of ACELP-type have a similar problem. The quantization of the location, amplitude and prefix of the pulses used consumes a large number of bits. A fixed-rate ACELP speech encoder calculates a certain number of pulses for each speech fame (or subframe) regardless of the original source signal. In this way it consumes the data transfer line capacity, reducing the total efficiency unnecessarily.

SUMMARY OF THE INVENTION

Because speech is typically partly voiced (a speech signal has a certain basic frequency) and partly toneless (greatly resembling noise), a speech encoder could further modify an excitation signal consisting of pulses and other parameters, as a function of the speech signal to be encoded. In this way it would be preferable to determine the excitation vector best suited for e.g. voiced and toneless speech segments with "right" accuracy (number of bits). Additionally, it would be possible to vary the number of excitation pulses in a code vector as a function of the analysis of the input speech signal. Through reliable selecting of the bit rate used for the presenting of excitation vectors and other speech parameter bits, the selecting being based upon the received signal and the performance of the encoding prior to the calculation of the excitation signals, the quality of the decoded speech in a receiver can be maintained constant regardless of the variations of excitation bit rate.

Now a method for selecting the encoding parameters to be used in speech synthesizing in a speech encoder has been invented, along with devices utilizing the method, through the utilizing of which the good features of fixed bit rate and variable bit rate speech encoding algorithms can be combined in order to realize a speech encoding system of good voice quality and high efficiency. The invention is suitable for use in various communication devices, such as mobile stations and telephones connected to telecommunication networks (telephone networks and packet switched networks such as Internet and ATM-network). It is possible to use a speech codec according to the invention also in various structural parts of telecommunication networks, as in connection with the base stations and base station controllers of mobile communication networks. What is characteristic of the invention is presented in the characteristics-sections of claims 1, 6, 7, 8 and 9.

The variable bit rate speech codec according to the invention is source-controlled (it is controlled based upon the analysis of the input speech signal) and it is capable of maintaining a constant speech quality by selecting a correct number of bits individually for each speech frame (the length of the speech frames to be encoded can be e.g. 20 ms). Accordingly, the number of bits used for encoding each speech frame is dependent of the speech information contained by the speech frame. The advantage of the source-controlled speech encoding method according to the invention is that the average bit rate used for speech encoding is lower than that of fixed rate speech encoder reaching the same voice quality. Alternatively, it is possible to use the speech encoding method according to the invention for obtaining better voice quality using the same average bit rate than a fixed bit rate speech codec. The invention solves the problem of selecting the correct quantities of bits used for the presentation of the speech parameters at speech synthesis. For example, in case of a voiced signal a large excitation code book is used, the excitation vectors are quantized more accurately, the basic frequency representing the regularity of the speech signal and/or the amplitude representing the strength of it are determined more accurately. This is carried out individually for each speech frame. In order to determine the quantities of bits used for the various speech parameters the speech codec according to the invention utilizes an analysis it performs using filters which model both the short-term and long-term recurrency of the speech signal (source signal). Decisive factors are among other things the voiced/toneless decision for a speech frame, the energy level of the envelope of the speech signal and its distribution to different frequency areas and the energy and the recurrency of the detected basic frequencies.

One of the purposes of the invention is to realize a speech codec operating at varying line speed providing fixed speech quality. On the other hand it is possible to use the invention also in speed codecs operating at fixed line speeds, in which the number of bits used for presenting the various speech parameters is adjusted within a data frame of standard length (a speech frame of e.g. 20 ms is standard in either case, both in the fixed and variable bit rate codecs). In this embodiment the bit rate used for presenting an excitation signal (excitation vector) is varied according to the invention, but correspondingly the number of bits used for presenting other speech parameters is adjusted in such a way that the total number of bits used for modelling a speech frame remains constant from one speech frame to another. In this way, e.g. when a large number of bits is used for modelling regularities occurring in a long-term (e.g. basic frequencies are encoded/quantified accurately), fewer bits remain for presenting the LPC (Linear Predicting Coding)-parameters representing short-term changes. Through selecting the quantities of bits used for presenting the various speech parameters in an optimal way, a fixed bit rate codec is obtained, which codec is always optimized as most suitable for the source signal. In this way a voice quality better than previously is obtained.

In a speech codec according to the invention it is possible to determine preliminarily the number of bits (the basic frequency presentation accuracy) used for presenting the basic frequency characteristic of each frame based upon parameters obtained using the so called open loop-method.

If required, it is possible to improve the accuracy of the analysis by using the so called closed loop-analysis. The result of the analysis is dependent of the input speech signal and of the performance of the filters used at the analysis. By determining the quantities of bits using the quality of the encoded speech as a criterion such a speech codec is achieved, the bit rate used for modelling the speech of which varies but the quality of the speech signal remains constant.

The number of bits modelling an excitation signal is independent of the calculation of other speech encoding parameters used for encoding the input speech signal and of the bit rate used for transferring them. Accordingly, in the variable bit rate speech codec according to the invention the selection of the number of bits used for creating an excitation signal is independent of the bit rate of the speech parameters used for other speech encoding. It is possible to transfer the information on the encoding modes used from an encoder to a decoder using side information bits, but the decoder can also be realized in such a way that the encoding mode selection algorithm of the decoder identifies the encoding mode used for encoding directly from the received bit flow.

BRIEF DESCRIPTION OF THE DRAWINGS

In the following the invention is explained in detail with reference to enclosed figures, in which.

DETAILED DESCRIPTION

Figure 1:
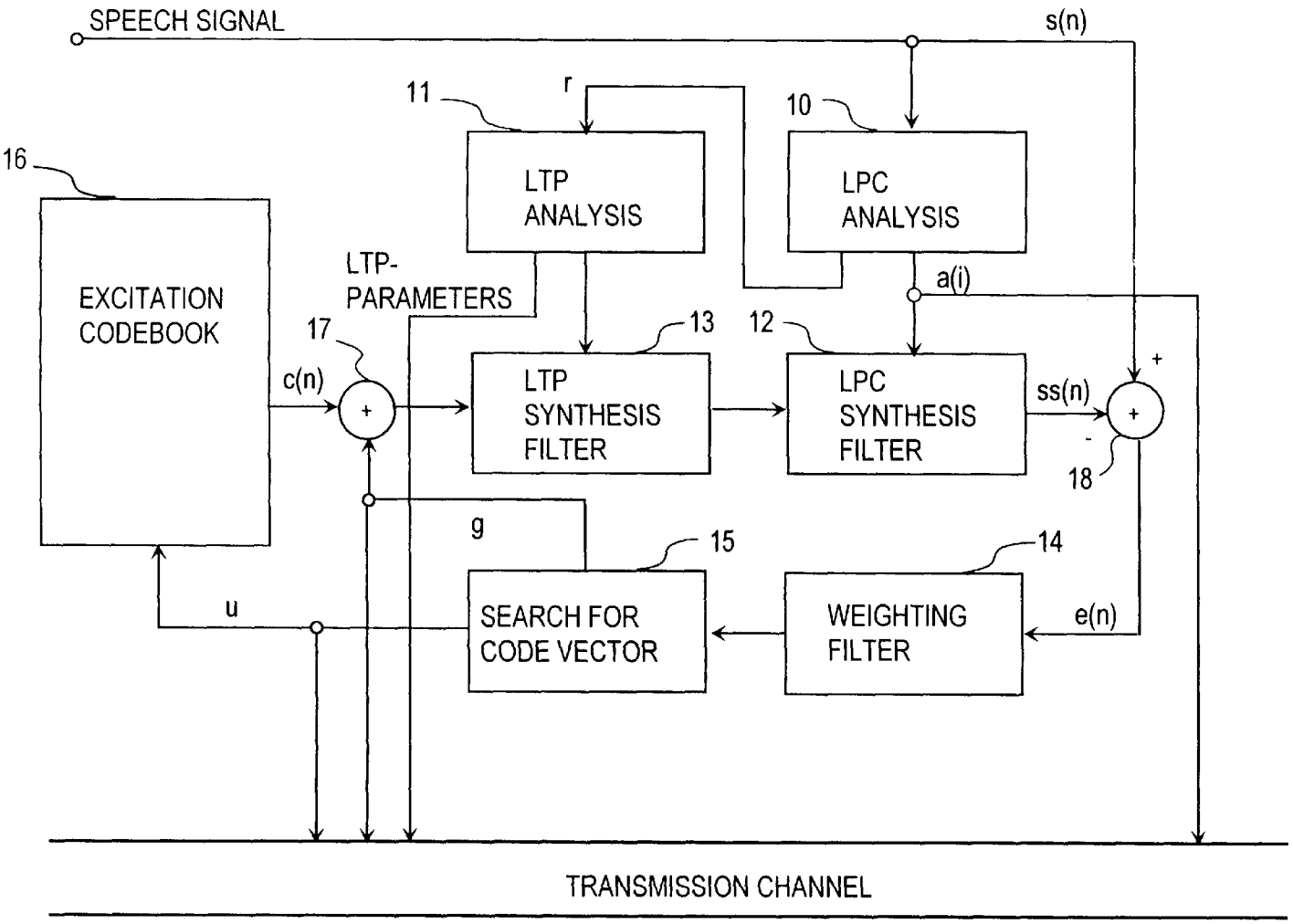
FIG. 1 presents the structure of a prior known CELP-encoder as a block diagram.

FIG. 1 presents as a block diagram the structure of a prior known fixed bit rate CELP-encoder, which forms the basis for a speech encoder according to the invention. In the following the structure of a prior known fixed-rate CELP-codec is explained for the parts which are connected to the invention. A speech codec of CELP-type comprises short-term LPC (Linear Predictive Coding) analysis block 10. LPC-analysis block 10 forms a number of linear prediction parameters a(i), in which i=1,2, . . . , m and m is the model order of the LPC-synthesizing filter 12 used in the analysis based upon input speech signal s(n). The set of parameters a(i) represents the frequency contents of the speech signal s(n), and it is typically calculated for each speech frame using N samples (e.g. if the sampling frequency used is 8 kHz, a 20 ms speech frame is presented with 160 samples). LPC-analysis 10 can also be performed more often, e.g. twice per a 20 ms speech frame. This is how it is proceeded with e.g. EFR (Enhanced Full Rate)-speech codec (ETSI GSM 06.60) prior known from the GSM-system. Parameters a(i) can be determined using e.g. Levinson-Durbin algorithm prior known to a person skilled in the art. The parameter set a(i) is used in short-term LPC-synthesizing filter 12 to form synthesized speech signal ss(n) using a transform function according to the following equation:

$$H(z) = \frac{1}{A(z)} = \frac{1}{1 + \sum_{i=1}^{m} a(i)z^{-i}} \tag{1}$$

in which

H=transform function,

A=LPC-polynom, z=unit delay, and m=the performance of LPC-synthesizing filter 12.

In LPC-analysis block 10 it is typically formed also LPC-residual signal r (LPC-residual), presenting long-term redundance present in speech, which residual signal is utilized in LTP (Long-term Prediction)-analysis 11. LPC-residual r is determined as follows, utilizing above LPC-parameters a(i):

$$r(n) = s(n) + \sum_{i=1}^{m} a_i s(n-i), \tag{2}$$

in which n=signal time, and a=LPC parameters

LPC residual signal r is directed further to long-term LTP-analysis block 11. The task of LTP-analysis block 11 is to determine the LTP-parameters typical for a speech codec: LTP-gain (pitch gain) and LTP-lag (pitch lag). A speech encoder further comprises LTP (Long-term Prediction)-synthesizing filter 13. LTP-synthesizing filter 13 is used to generate the signal presenting the periodicity of speech (among other things the basic frequency of speech, occurring mainly in connection with voiced phoneme). Short-term LPC-synthesizing filter 12 again is used for the fast variations of frequency spectrum (for example in connection with toneless phoneme). The transform function of LTP-synthesizing filter 13 is typically of form:

$$\frac{1}{B(z)} = \frac{1}{1 - gz^{-T}}, \tag{3}$$

in which

B=LTP-polynom, g=LTP-pitch gain, and

T=LTP-pitch lag.

LTP-parameters are in speech codec determined typically by subframes (5 ms). In this way both analysis-synthesis filters 10, 11, 12, 13 are used for modelling speech signal s(n). Short-term LPC-analysis-synthesis filter 12 is used to model the human vocal tract, while long-term LTP-analysis-synthesis filter 13 is used to model the vibrations of the vocal cords. An analysis filter models and a synthesis filter then generates a signal utilizing this model.

Weighting filter 14, the function of which is based on the characteristics of human hearing sense, is used to filter error signal e(n). Error signal e(n) is a difference signal between original speech signal s(n) and synthesized speech signal ss(n) formed in summing unit 18. Weighing filter 14 attenuates the frequencies on which the error inflicted in speech synthesizing is less disturbing for the understandability of speech, and on the other hand amplifies frequencies having great significance for the understandability of speech. The excitation for each speech frame is formed in excitation code book 16. If such a search is used in CELP-encoder which checks all excitation vectors, all scaled excitation vectors c(n) are processed in both long-term and short-term synthesizing filters 12, 13 in order to find the best excitation vector c(n). Excitation vector search controller 15 searches index u of excitation vector c(n), contained in excitation code book 16, based upon the weighted output of weighting filter 14. During an iteration process index u of the optimal excitation vector c(n) (resulting in speech synthesis best corresponding with the original speech signal) is selected, in other words, index u of the excitation vector c(n) which results in the smallest weighted error.

Scaling factor g is obtained from excitation vector c(n) search controller 15. It is used in multiplying unit 17 for multiplying the excitation vector c(n) selected from excitation code book 16 for output. The output of multiplying unit 17 is connected to the input of long-term LTP-synthesis filter 13. To synthesize the speech in the receiving end LPC-parameters a(i), LTP-parameters, index u of excitation vector c(n) and scaling factor g, generated by linear prediction, are forwarded to a channel encoder (not shown in the figure) and transmitted further through a data transfer channel to a receiver. The receiver comprises a speech decoder which synthesizes a speech signal modelling the original speech signal s(n) based upon the parameters it has received. In the presentation of LPC-parameters a(i) it is also possible to convert the presented LPC-parameters a(i) into e.g. LSP-presentation form (Line Spectral Pair) or into ISP-presentation form (Immittance Spectral Pair) in order to improve the quantization properties of the parameters.

Figure 2:
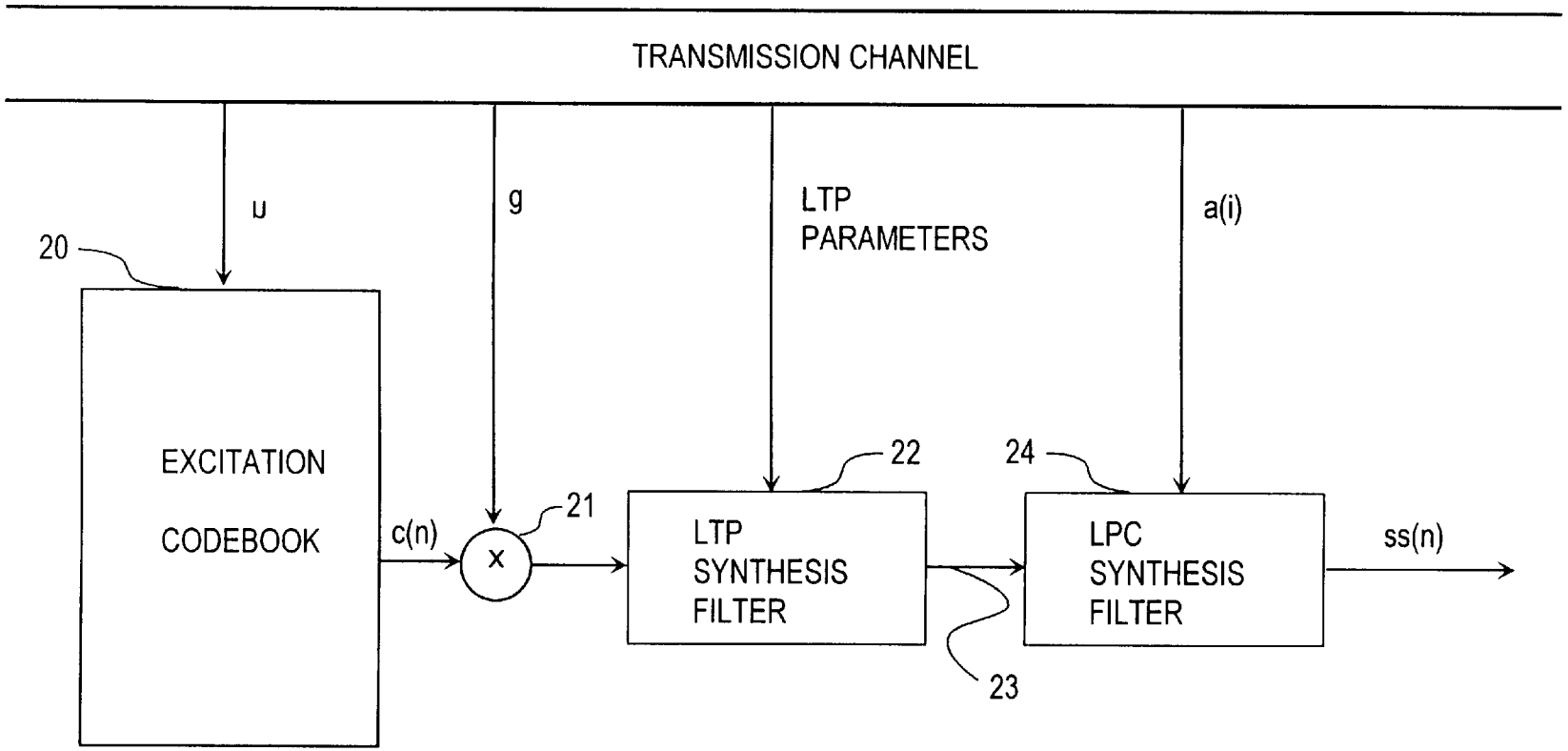
FIG. 2 presents the structure of a prior known CELP-decoder as a block diagram.

FIG. 2 presents the structure of a prior known fixed rate speech decoder of CELP-type. The speech decoder receives LPC-parameters a(i), LTP-parameters, index u of excitation vector c(n) and scaling factor g, produced by linear prediction, from a telecommunication connection (more accurately from e.g. a channel decoder). The speech decoder has excitation code book 20 corresponding to the one in speech encoder (ref. 16) presented above in FIG. 1. Excitation code book 20 is used for generating excitation vector c(n) for speech synthesis based upon received excitation vector index u. Generated excitation vector c(n) is multiplied in multiplying unit 21 by received scaling factor g, after which the obtained result is directed to long-term LTP-synthesizing filter 22. Long-term synthesizing filter 22 converts the received excitation signal c(n)*g LTP parameters it has received from the speech encoder through data transfer bus and sends modified signal 23 further to short-term LPC-synthesizing filter 24. Controlled by LPC-parameters a(i) produced by linear prediction, short-term LPC-synthesizing filter 24 reconstructs short-term changes occurred in the speech, implements them in signal 23, and decoded (synthesized) speech signal ss(n) is obtained in the output of LPC-synthesizing filter 24.

Figure 3:
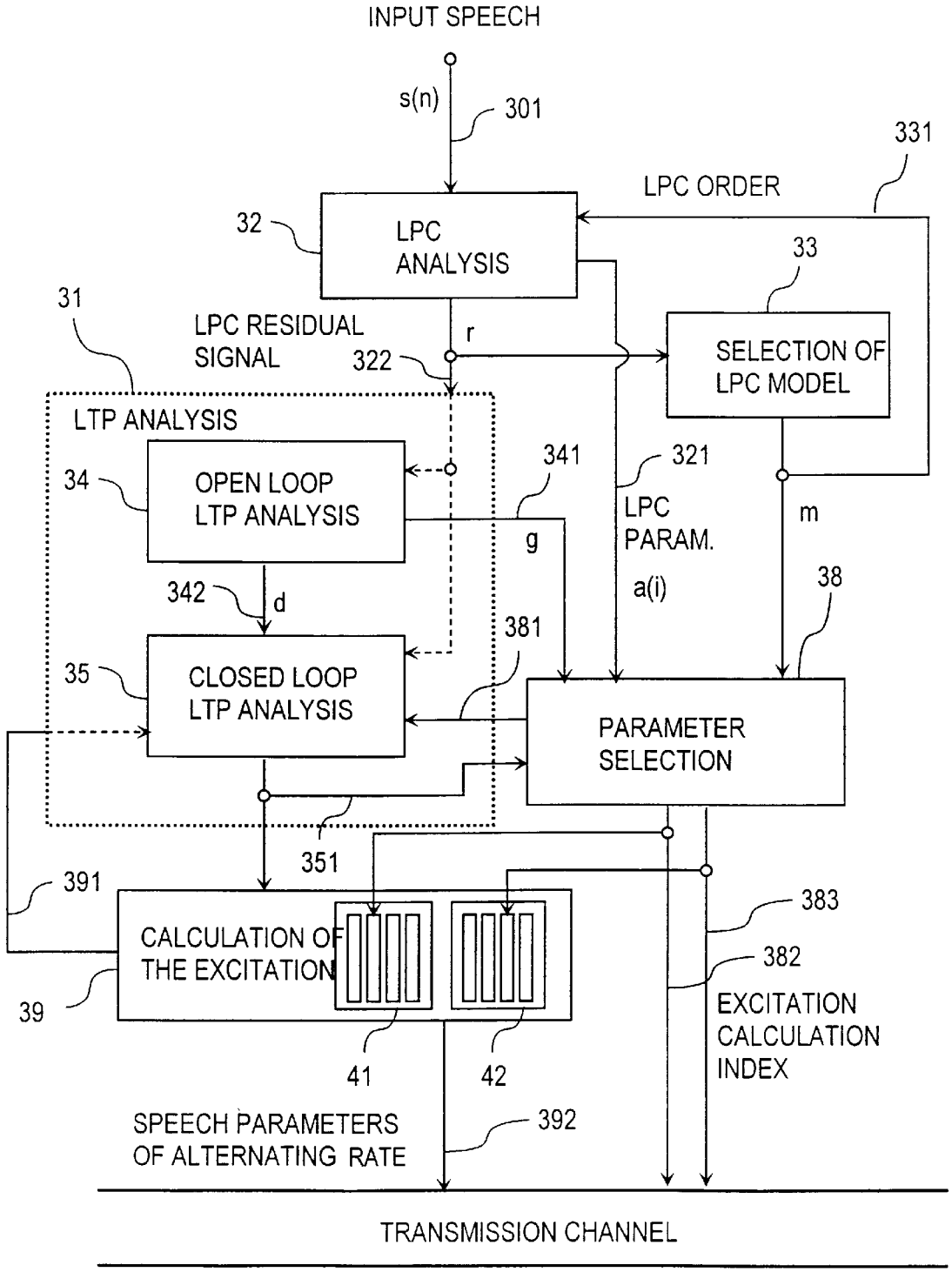
FIG. 3 presents the structure of an embodiment of the speech encoder according to the invention as a block diagram.

FIG. 3 presents as a block diagram an embodiment of a variable bit rate speech encoder according to the invention. Input speech signal s(n) (ref. 301) is first analyzed in linear LPC-analysis 32 in order to generate LPC-parameters a(i) (ref. 321) presenting short-term changes in speech. LPC-parameters 321 are obtained e.g. through autocorrelation method using the above mentioned Levinson-Durbin method prior known to a person skilled in the art. Obtained LPC-parameters 321 are directed further to parameter selecting block 38. In LPC-analysis block 32 also the generating of LPC-residual signal r (ref. 322) is performed, which signal is directed to LTP-analysis 31. In LTP-analysis 31 the above mentioned LTP-parameters presenting long-term changes in speech are generated. LPC-residual signal 322 is formed by filtering speech signal 301 with the inverse filter H(Z)=1/A(z), i.e. LPC-synthesizing filter (see equation 1 and FIG. 1). LPC-residual signal 322 is also brought to LPC-model order selecting block 33. In LPC-model performance selecting block 33 the required LPC-model order 331 is estimated using e.g. Akaike Information Criterion (AIC) and Rissanen's Minimum Description Length (MDL)-selection criteria. LPC-model order selecting block 33 forwards the information about LPC-order 331 to be used in LPC-analysis block 32 and according to the invention to parameter selecting block 38.

FIG. 3 presents a speech encoder according to the invention realized using two-stage LTP-analysis 31. It uses open loop LTP-analysis 34 for searching the integer d (ref. 342) of LTP-pitch lag term T, and closed loop LTP-analysis 35 for searching the fraction part of LTP-pitch lag T. In the first embodiment of the invention LPC-parameters 321 and LTP residual signal 351 are utilized for the calculation of speech parameter bits 392 in block 39. The decision of the speech encoding parameters to be used for speech encoding and of their presentation accuracy is made in parameter selecting block 38. In this way according to the invention, the performed LPC-analysis 32 and LTP-analysis 31 can be utilized for optimizing speech parameter bits 392.

In another embodiment of the invention the decision of the algorithm to be used for searching the fraction part of LTP-pitch lag T is made based upon LPC-synthesizing filter order m (ref. 331) and gain term g (ref. 341) calculated in open-loop LTP-analysis 34. Also this decision is made in parameter selecting block 38. According to the invention the performance of LTP-analysis 31 can in this way be improved significantly by utilizing the already performed LPC-analysis 32 and the already partly performed LTP-search (open-loop LTP-analysis 34). The search of the fractional LTP-pitch lag used in the LTP-analysis has been described e.g. in publication: Peter Kroon & Bishnu S. Atal "Pitch Predictors with High Temporal Resolution" Proc of ICASSP-90 pages 661–664.

The determining of integer d of the LTP-pitch lag term T, performed by open-loop LTP-analysis 35, can be performed for example by using autocorrelation method and by determining the lag corresponding to the maximum of the correlation function using the following equation:

$$\hat{R}(d) = \sum_{n=0}^{N-1} r(n-d)r(n),\ d = d_L, \ldots, d_H \tag{4}$$

in which r(n)=LPC-residual signal 322 d=the pitch presenting the basic frequency of speech (integer of LTP-pitch lag term, and $d_L$ and $d_H$ are the search limits for the basic frequency.

Open-loop LTP-analysis block 34 also produces open-loop gain term g (ref. 341) using LPC-residual signal 322 and integer d found at LTP-pitch lag term search as follows:

$$g = \frac{\sum_{n=0}^{N-1} r(n)r(n-d)}{\sum_{n=0}^{N-1} r(n-d)^2} \tag{5}$$

in which r(n)=LPC-residual signal (residual signal 322), d=LTP-pitch-lag integer delay, and N=frame length (e.g. 160 samples, when a 20 ms frame is sampled at 8 kHz frequency)

Parameter selecting block utilizes in this way in the second embodiment of the invention the open-loop gain term g for improving the accuracy of LTP-analysis 31.

Closed-loop LTP-analysis block 35 correspondingly searches the accuracy of the fraction part of LTP-pitch lag term T utilizing the above determined integer lag term d. Parameter selecting block 38 is capable of utilizing at the determining of the fraction part of LTP-pitch lag term e.g. a method which has been mentioned in reference: Kroon, Atal "Pitch Predictors with High Temporal Resolution". Closed-loop LTP-analysis block 35 determines, in addition to above LTP-pitch lag term T, the final accuracy for LTP-gain g, which is transmitted to the decoder in the receiving end.

Closed-loop LTP-analysis block 35 also generates LTP-residual signal 351 by filtering LPC-residual signal 322 with an LTP-analysis filter, in other words with a filter the transfer function of which is the inverse function H(Z)=1/B(z) (see equation 3). LTP-residual signal 351 is directed to excitation signal calculating block 39 and to parameter selecting block 38. The closed-loop LTP-search typically utilizes also previously determined excitation vectors 391. In a codec of ACELP-type (e.g. GSM 06.60) according to prior art, a fixed number of pulses is used for encoding excitation signal c(n). Even the accuracy of presenting the pulses is constant, and accordingly, excitation signal c(n) is selected from one fixed code book 60. In the first embodiment of the invention parameter selecting block 38 comprises the selector of excitation code book 60-60''' (shown in FIG. 4) which, based upon LTP-residual signal 351 and LPC-parameters 321, decides with which accuracy (with how many bits) the excitation signal 61-61''' (FIG. 6B) used for modelling speech signal s(n) in each speech frame is presented. By changing either the number of excitation pulses 62 used in the excitation signals or the accuracy used for quantizing excitation pulses 62, several different excitation code books 60-60''' can be formed. It is possible to transfer the information upon the accuracy (code book) to be used for presenting the excitation code to excitation code calculating block 39 and to a decoder for example using excitation code book selecting index 382, which indicates which excitation code book 60-60''' is to be used for both speech encoding and decoding. In a way similar to selecting with signal 382 the required excitation code book 60-60''' in excitation code book library 41, the presentation and calculating accuracy of other speech parameter bits 392 is selected using corresponding signals. This is explained in more detail in connection with the explanation of FIG. 7, in which the accuracy used for calculating the LTP-pitch lag term is selected with signal 381 (=383). This is presented by lag-term calculating accuracy selecting block 42. In a corresponding way the accuracy used for calculating and presenting also other speech parameters 392 is selected (for example the presentation accuracy for LPC-parameters 321 characteristic of codecs of CELP-type). Excitation signal calculating block 39 is assumed to comprise filters corresponding to LPC-synthesis filter 12 and LTP-synthesis filter 13 presented in FIG. 1, with which the LPC-and LTP-analysis-synthesis is realized. Variable-rate speech parameters 392 (e.g. LPC- and LTP-parameters) and the signals for the encoding mode used (e.g. signals 382 and 383) are transferred to the telecommunication connection for transmission to the receiver.

Figure 4:
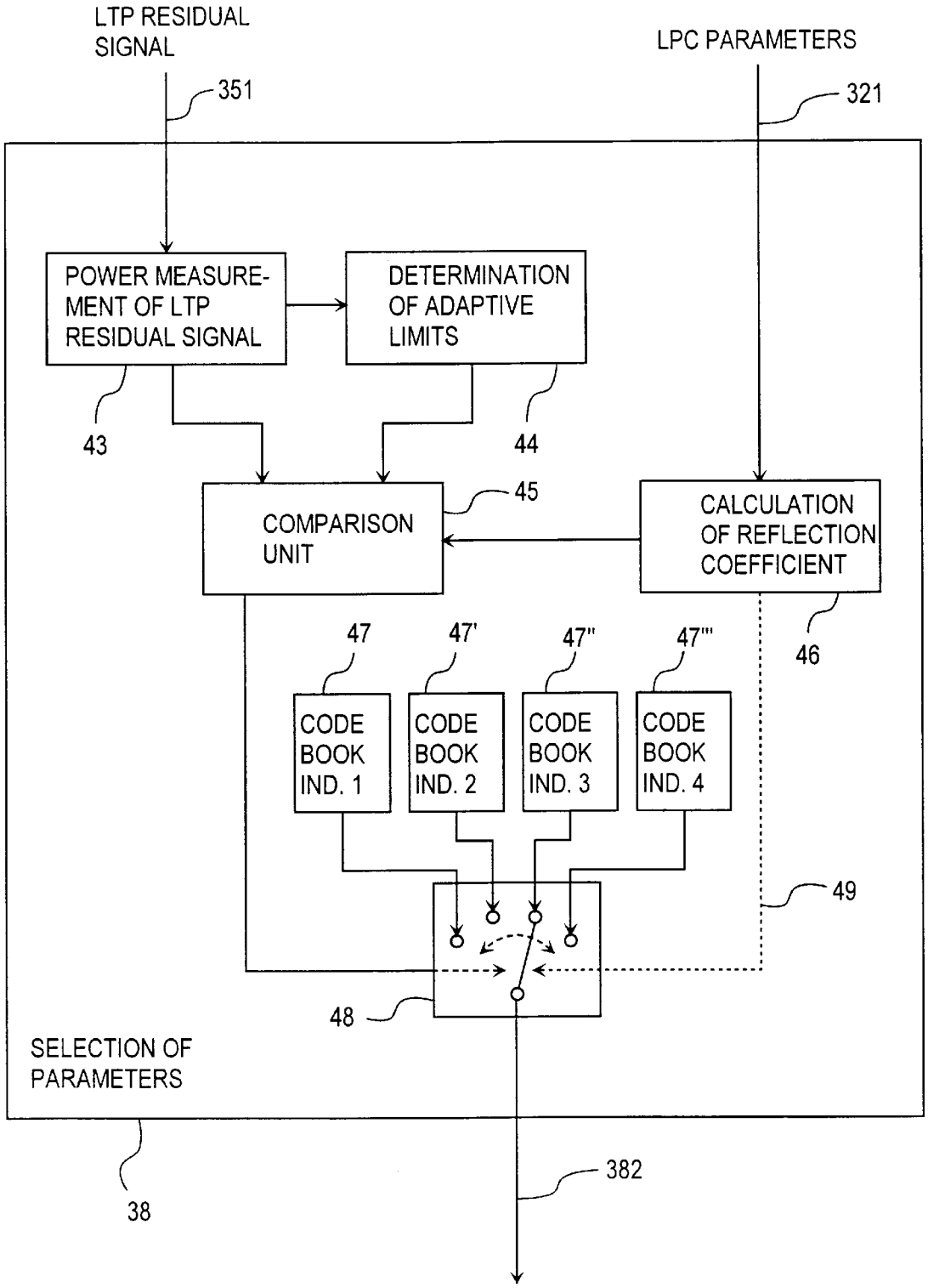
FIG. 4 presents the function of the parameter selecting block as a block diagram when selecting a code book.
Figure 5A:
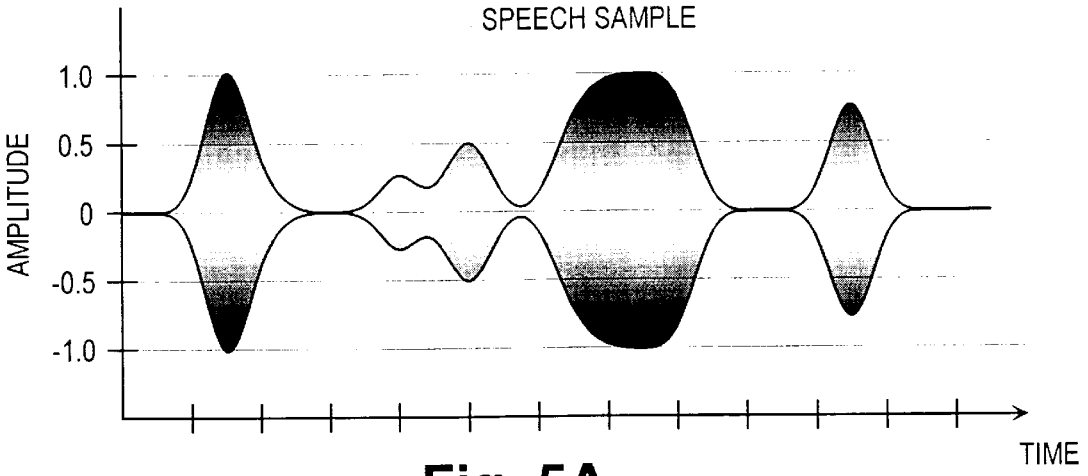
FIG. 5A presents in time-amplitude level an exemplary speech signal used for explaining the function of the invention.
Figure 5B:
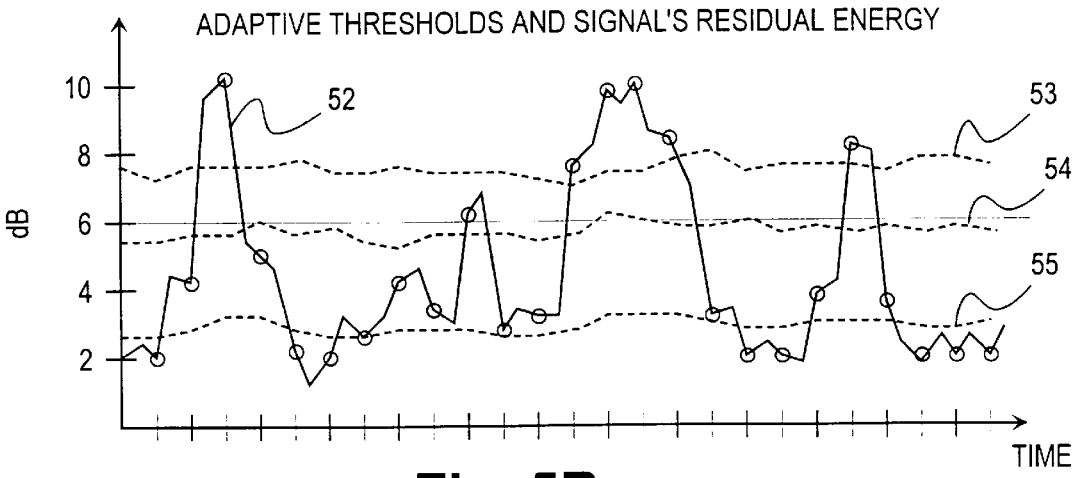
FIG. 5B presents the adaptive limit values used in the realization of the invention and the residual energy of the exemplary speech signal in time-dB level.

FIG. 4 presents the function of parameter selecting block 38 when determining excitation signal 61-61''' used for modelling speech signal s(n). At first parameter selecting block 38 performs two calculating operations to LTP-residual signal 351 it has received. The residual energy-value 52 (FIG. 5) of LTP-residual signal 351 is measured in block 43 and transferred to both adaptive limit value determination block 44 and to comparison unit 45. FIG. 5A presents an exemplary speech signal and FIG. 5B presents in time-level residual energy-value 52 remaining of the same signal after encoding. In adaptive limit value determination block 44 adaptive limit values 53, 54, 55 are determined based upon above measured residual energy-value 52 and upon the residual energy-values of previous speech frames. Based upon these adaptive limit values 53, 54, 55 and upon residual energy-value 52 of the speech frame, the accuracy (number of bits) used for presenting excitation vector 61-61''' is selected in comparison unit 45. The basic idea in using one adaptive limit value 54 is, that if the residual energy-value 52 of the speech frame to be encoded is higher than the average value of the residual energy-values of previous speech frames (adaptive limit value 54) the presentation accuracy of excitation vectors 61-61''' is increased in order to obtain a better estimate. In this case residual energy-value 52 occurring at the next speech frame can be expected to be lower. If, on the other hand, residual energy-value 52 stays below adaptive limit value 54, it is possible to reduce the number of bits used for presenting excitation vector 61-61''' without reducing the quality of speech.

An adaptive threshold value is calculated according to the following equation:

$$G_{dBthr_0}=(1-\alpha)(G_{dB}+\Delta G_{dB})+\alpha G_{dBthr\text{-}1} \tag{6}$$

in which $G_{dBthr_0}$=adaptive threshold value,

α=factor for low-pass filter (e.g. 0.995)

$G_{dB}$=signal in input (logarithmic energy, ref. 52)

$\alpha G_{dB}$=scaling factor (e.g. −1.0 dB)

Figure 5C:
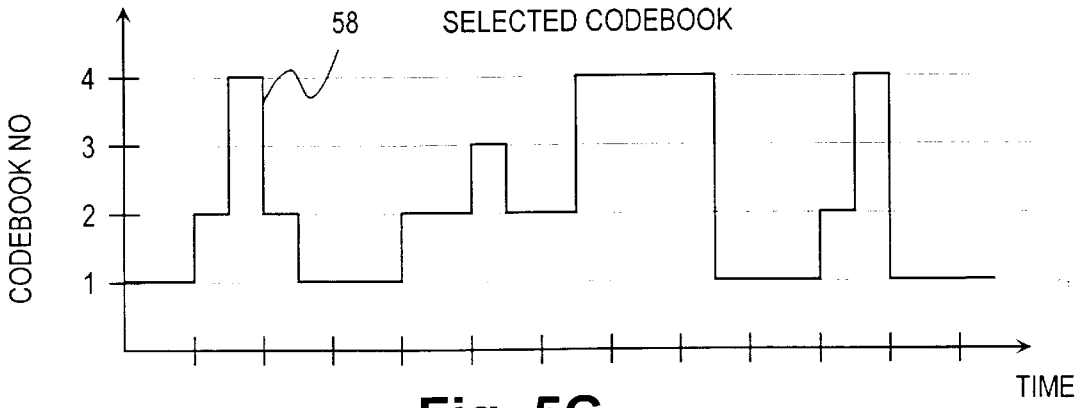
FIG. 5C presents the excitation code book numbers for each speech frame, selected based upon FIG. 5B, used for modelling the speech signal.

When there are more than two excitation code books 60-60''' available, in which books the excitation vectors 61-61''' to be used are selected, the speech encoder requires more limit values 53, 54, 55. These other adaptive limit values are formed by changing factor $\alpha G_{dB}$ in the equation determining the adaptive limit values. FIG. 5C presents the number of excitation code book 60-60''' selected according to FIG. 5B, when in the example there are four different excitation code books 60-60''' available. The selection is formed for example according to table 1 as follows:

TABLE 1

Selection of excitation code book

| | The number of the excitation code book to be used | | | |
|---|---|---|---|---|
| Residual energy-value (Ref. 52) | 1 | 2 | 3 | 4 |
| energy < limit value 55 | X | | | |
| limit value 55 ≦ energy < limit value 54 | | X | | |
| limit value 54 ≦ energy < limit value 53 | | | X | |
| energy ≧ limit value 53 | | | | X |

It is characteristic of the speech encoder according to the invention that each excitation code book 60-60''' uses a certain number of pulses 62-62''' for presenting excitation vectors 61-61''' and an algorithm based upon quantizing at a certain accuracy. This means that the bit rate of an excitation signal used for speech encoding is dependent on the performances of linear LPC-analysis 32 and LTP-analysis 31 of the speech signal.

The four different excitation code books 60-60''' used in the example can be distinguished using two bits. Parameter selecting block 38 transfers this information in form of signal 382 to both excitation calculating block 39 and to the data transfer channel for transfer to the receiver. The selecting of excitation code book 60-60''' is carried out using switch 48, based upon the position of which excitation code book index 47-47''' corresponding to selected excitation code book 60-60''' is transferred further as signal 382. Excitation code book library 65 containing above excitation code books 60-60''' is stored in excitation calculating block 39, from which excitation vectors 61-61''' contained by correct excitation code book 60-60''' can be retrieved for speech synthesis.

The above method for selecting excitation code book 60-60''' is based upon the analysis of LTP-residual signal 351. In another embodiment of the invention it is possible to combine a control term in the selecting criteria of excitation code book 60-60''', which enables controlling of the correctness of the selecting of excitation code book 60-60'''. It is based upon examining the speech signal energy distribution in the frequency domain. If the energy of a speech signal is concentrated in the lower end of the frequency range, most certainly a voiced signal is concerned. Based upon experiments on voice quality, high quality encoding of voiced signals requires more bits than the encoding of unvoiced signals. In the case of a speech encoder according to the invention it means that the excitation parameters used for synthesizing a speech signal must be presented more accurately (using a higher number of bits). On connection with the example handled in FIGS. 4 and 5A–5C this results in, that such an excitation code book 60-60''' has to be selected which presents excitation vectors 61-61''' using a larger number of bits (a code book with higher number, FIG. 5C).

The two first reflection coefficients of LPC-parameters 321 obtained in LPC-analysis 32 give a good estimate of the energy distribution of the signal. The reflection coefficients are calculated in reflection coefficient calculating block 46 (FIG. 4) using for example Shur- or Levinson algorithms prior known to a person skilled in the art. If the two first reflection factors RC1 and RC2 are presented in a plane (FIG. 6A) it is easy to detect energy concentrations. If reflection coefficients RC1 and RC2 occur in the low frequency area (ruled area 1), most certainly a voiced signal is concerned, while if the energy concentration occurs at high frequencies (ruled area 2), a toneless signal is concerned. Reflection coefficients have values in the range of −1 to 1. Limit values (such as RC=−0.7 . . . −1 and RC"=0 . . . 1, as in FIG. 6A) are selected experimentally by comparing reflection coefficients caused by voiced and toneless signals. When reflection coefficients RC1 and RC2 occur in the voiced range, such a criterion is used which selects excitation code book 60-60''' with a higher number and more accurate quantization. In other cases excitation code book 60-60''' corresponding with a lower bit rate can be selected. The selecting is carried out using switch 48 controlled by signal 49. Between these two ranges there is an interim area, in which a speech encoder can make the decision of the excitation code book 60-60''' to be used based mainly upon LTP-residual signal 351. When the above methods based upon measuring LTP-residual signal 351 and calculating reflection coefficients RC1 and RC2 are combined, an effective algorithm for selecting excitation code book 60-60''' is established. It is capable of reliably selecting an optimal excitation code book 60-60''' and guarantees speech encoding of even quality for speech signals of different type and with required voice quality. A corresponding method of combining criteria can be used also for determining other speech parameter bits 392, as it will be evident in connection with the explanation of FIG. 7. One of the additional benefits of combining the methods is that if for one reason or another the selecting of excitation code book 60-60''' based upon LTP-residual signal 351 is not successful, the error can in most cases be detected and corrected before speech encoding using the method based upon calculating reflection coefficients RC1 and RC2 for LPC-parameters 321.

It is possible to utilize the above voiced/unvoiced-decision, based upon measuring LTP-residual signal 351 and calculating reflection coefficients RC1 and RC2 for LPC-parameters 321, in the speech encoding method according to the invention in the accuracy used at presenting and calculating even LTP-parameters, essentially LTP-gain g, LTP-lag T. LTP-parameters g and T present long-term recurrencies in speech, such as the basic frequency characteristic of a voiced speech signal. A basic frequency is the frequency at which an energy concentration occurs in a speech signal. Recurrencies are measured in a speech signal in order to determine the basic frequency. This is effected by measuring, using LTP-pitch lag term, the incidence of pulses occurring repeatedly almost similar. The value of LTP-pitch lag term is the delay between the occurrence of a certain speech signal pulse until the moment the same pulse reoccurs. The basic frequency of the detected signal is obtained as the inverse of LTP-pitch lag term.

In several speech codecs utilizing LTP-technology, as e.g. in CELP-speech codecs, LTP-pitch lag term is searched for in two stages using first the so-called open-loop method and then the so-called closed-loop method. The purpose of the open-loop method is to find from LPC-residual signal 322 of LPC-analysis 32 of the speech frame to be analyzed integer estimate d for LTP-pitch lag term using some flexible mathematical method, such as e.g. autocorrelation method presented in connection with equation (4). In the open-loop method the calculating accuracy of LTP-pitch lag term depends on the sampling frequency used at modelling the speech signal. It often is too low (e.g. 8 kHz) for obtaining a for speech quality sufficiently accurate LTP-pitch lag term. In order to solve this problem the so-called closed-loop method has been developed, the purpose of which is to search more accurately for the LTP-pitch lag term value in the vicinity of the LTP-pitch lag term value found using the open-loop method, using over-sampling. In prior known speech codecs either open-loop method is used (the value of LTP-pitch lag term is searched for only with the accuracy of so-called integer), or connected with it the closed-loop method using fixed over-sampling coefficient. If for example over-sampling coefficient 3 is used, LTP-pitch lag term value can be found three times more accurately (so-called ⅓-fraction accuracy). An example of a method of this kind has is described in publication: Peter Kroon & Bishnu S. Atal "Pitch Predictors with High Temporal Resolution" Proc of ICASSP-90 pages 661–664.

In speech synthesis the accuracy required for presenting the basic frequency characteristic of a speech signal is essentially dependent on the speech signal. It is because of this that it is preferable to adjust the accuracy (number of bits) used for calculating and presenting the frequencies modelling a speech signal in many levels as a function of the speech signal. As selection criteria e.g. the energy contents of speech or the voiced/toneless decision is used just like they were used for selecting excitation code book 60-60''' in connection with FIG. 4.

Figure 7:
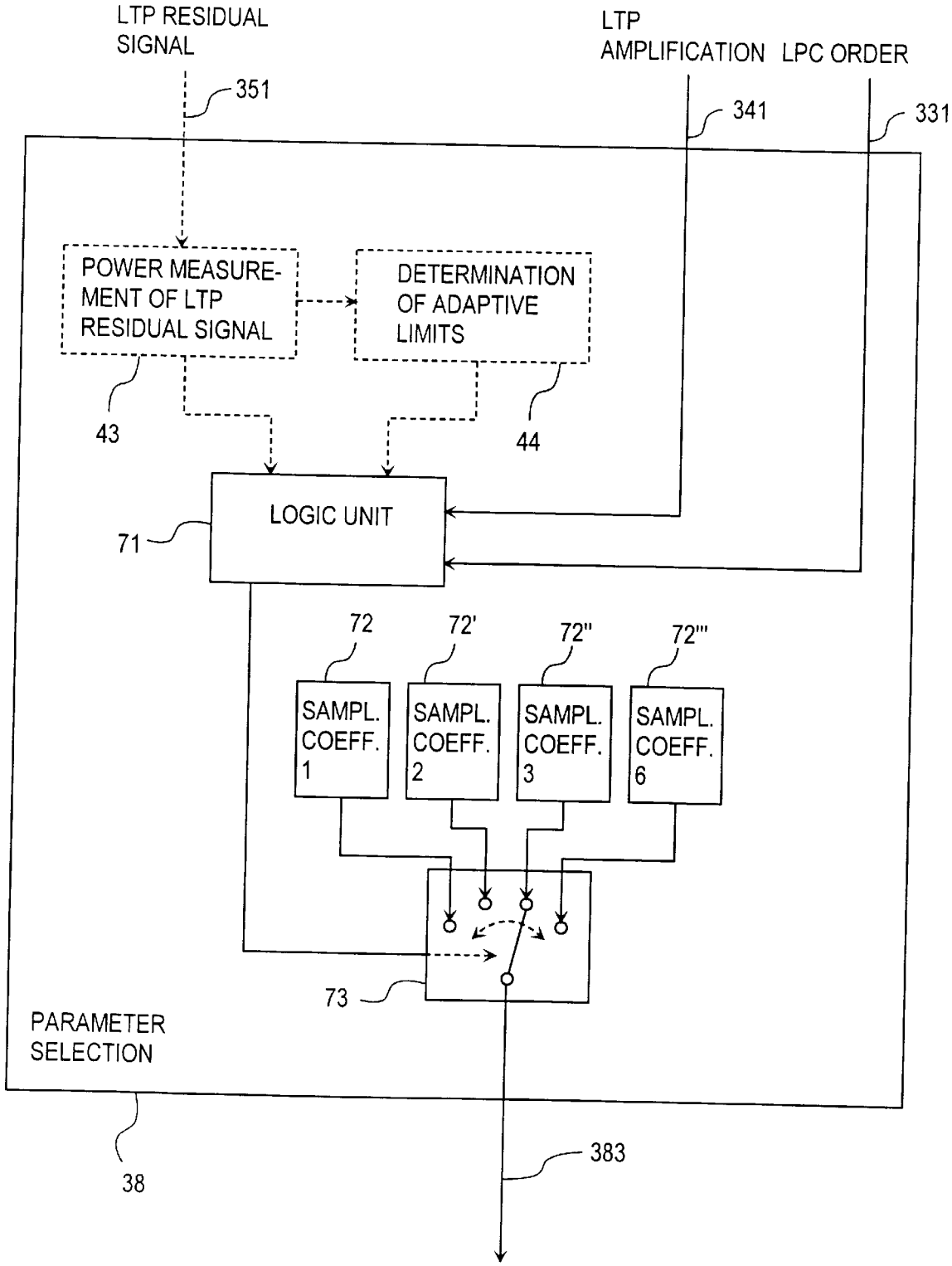
FIG. 7 presents as a block diagram the function of the parameter selecting block from point of view of the basic frequency presentation accuracy.

A variable rate speech encoder according to the invention producing speech parameter bits 392 uses open-loop LTP-analysis 34 for finding integer part d (open loop gain) of LTP-pitch lag and closed-loop LTP-analysis 35 for searching the fraction part of LTP-pitch lag. Based upon open-loop LTP-analysis 34, the performance used in LPC-analysis and the reflection coefficients, a decision is made also on the algorithm used for searching the fraction part of LTP-pitch lag. Also this decision is made in parameter selecting block 38. FIG. 7 presents the function of parameter selecting block 38 from the point of view of the accuracy used at searching LTP-parameters. The selection is preferably based upon the determining of open loop LTP-gain 341. As selecting criteria in logic unit 71 it is possible to use criteria alike the adaptive limit values explained in connection with FIGS. 5A–5C. In this way it is possible to form an algorithm selecting table, according to table 1, to be used in the calculating of LTP-pitch lag T, based upon which selecting table the accuracy used for presenting and calculating the basic frequency (LTP-pitch lag) is determined.

Order 331 of LPC-filter required for LPC-analysis 32 gives also important information about a speech signal and the energy distribution of the signal. For the selecting of model order 331 used in the calculating of LPC-parameters 32, for example the prior mentioned Akaike Information Criterion (ARC) or Rissanen's Minimum Description Length (MDL)-method is used. The model order 331 to be used in LPC-analysis 32 is selected in LPC-model selecting unit 33. For signals the energy distribution of which is even, a 2-stage LPC-filtering is often sufficient for modelling, while for voiced signals containing several resonance frequencies (formant frequencies) for example 10-stage LPC-modelling is required. Exemplary table 2 is presented below, which table presents the oversampling factor used for calculating LTP-pitch lag term T as a function of model order 331 of the filter used in LPC-analysis 32.

TABLE 2 selecting pitch-lag algorithm as a function of the model order used in LPC-analysis.

| | Oversampling factor to be used | | | |
|---|---|---|---|---|
| The model order of the LPC - analysis | 1 | 2 | 3 | 6 |
| model order < 6 | X | | | |
| 6 ≦ model order < 8 | | X | | |

TABLE 2-continued selecting pitch-lag algorithm as a function of the model order used in LPC-analysis.

| | Oversampling factor to be used | |
|---|---|---|
| 8 ≦ model order < 10 | X | |
| model order ≧ 10 | | X |

A high value of LTP-open-loop gain g indicates a highly voiced signal. In this case the value of LTP-pitch lag characteristic of LTP-analysis must, in order to obtain good voice quality, be searched with high accuracy. In this way it is possible, based upon LTP-gain 341 and model order 331 used in LPC-synthesis, to form table 3.

TABLE 3 selecting of oversampling factor as a function of the model order used in LPC-analysis and of the open loop gain.

| | Open loop gain | |
|---|---|---|
| The model order of the LTP - analysis | <0.6 | ≧0.6 |
| model order < 6 | 1 | 6 |
| 6 ≦ model order < 8 | 2 | 6 |
| 8 ≦ model order < 10 | 3 | 6 |
| model order ≧ 10 | 6 | 6 |

Figure 6A:
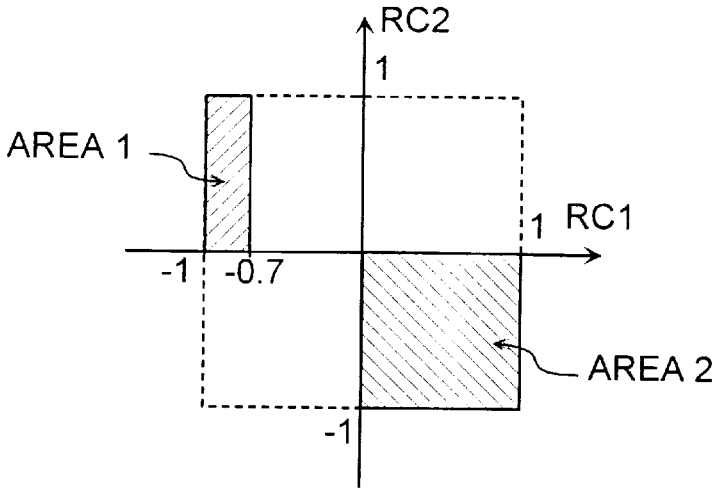
FIG. 6A presents a speech frame analysis based upon calculating reflection coefficients.
Figure 6B:
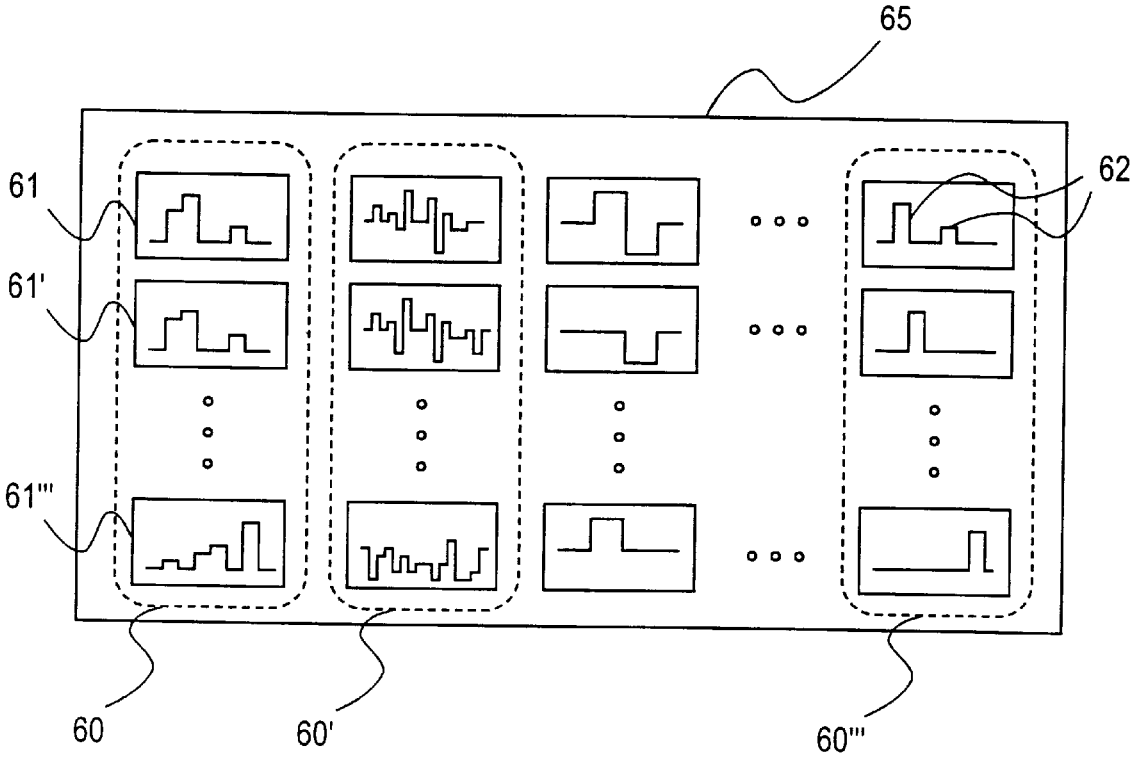
FIG. 6B presents the structure of the excitation code book library used in the speech encoding method according to the invention.

If the spectral envelope of a speech signal is concentrated at low frequencies, it is advisable to select also a high oversampling factor (the frequency distribution is obtained e.g. from reflection coefficients RC1 and RC2 of LPC-parameters 33, FIG. 6A). This can also be combined with above mentioned other criteria. Oversampling factor 72-72'''itself is selected by switch 73, based upon a control signal obtained from logic unit 71. Oversampling factor 72-72''' is transferred to closed loop LTP-analysis 35 with signal 381, and to excitation calculating block 39 and data transfer channel as signal 383 (FIG. 3). When for example 2, 3, and 6 times oversampling is used, as in connection with tables 2 and 3, the value of LTP-pitch lag can correspondingly be calculated with the accuracy of ½, ⅓, and ⅙ of the sampling interval used.

In closed loop LTP-analysis 35 the fraction value of LTP-pitch lag T is searched with the accuracy determined by logic unit 71. LTP-pitch lag T is searched by correlating LPC-residual signal 322 produced by LPC-analysis block 32 and excitation signal 391 used at the previous time. Previous excitation signal 391 is interpolated using the selected oversampling factor 72-72'''. When the fraction value of LTP-pitch lag produced by the most exact estimate has been determined, it is transferred to the speech encoder together with the other variable rate speech parameter bits 392 used in speech synthesizing.

Figure 8:
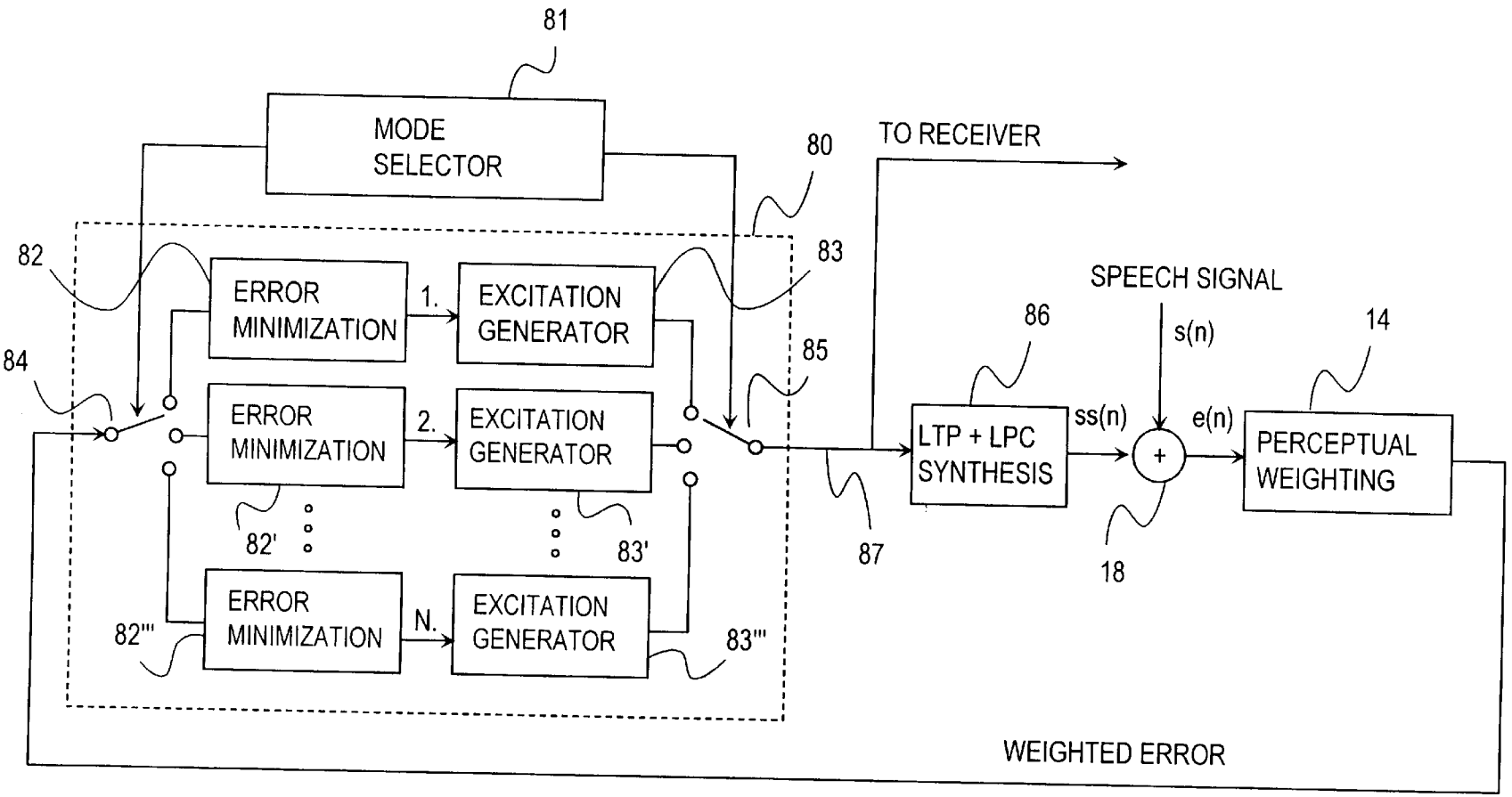
FIG. 8 presents the function of a speech encoder according to the invention as an entity.

In FIGS. 3, 4, 5A–5C, 6A–6B and 7 the function of a speech encoder producing variable rate speech parameter bits 392 was presented in detail. FIG. 8 presents the function of a speech encoder according to the invention as an entity. Synthesized speech signal ss(n) is deducted from speech signal s(n) in summing unit 18, alike in the prior known speech encoder presented in FIG. 1. The obtained error signal e(n) is weighted using perceptual weighting filter 14. The weighed error signal is directed to variable rate parameter generating block 80. Parameter generating block 80 comprises the algorithms used for calculating the above described variable bit rate speech parameter bits 392 and the excitation signals, out of which mode selector 81 selects, using switches 84 and 85, the speech encoding mode optimal for each speech frame. Accordingly, there are separate error minimizing blocks 82-82''' of their own for each speech encoding mode, which minimizing blocks 82-82''' calculate optimal excitation pulses and other speech parameters 392 with selected accuracy for prediction generators 83-83'''. Prediction generators 83-83''' generate among other things excitation vectors 61-61''' and transfer them and other speech parameters 392 (such as for example LPC-parameters and LTP-parameters) with the selected accuracy further to LTP+LPC-synthesis block 86. Signal 87 represents those speech parameters (e.g. variable rate speech parameter bits 392 and speech encoding mode selecting signals 282 and 283) which are transferred to a receiver through the data transfer channel. Synthesized speech signal ss(n) is generated in LPC-and LIP-synthesizing block 86 based upon speech parameters 87 generated by parameter generating block 80. Speech parameters 87 are transferred to channel encoder (not shown in the figure) for transmission to the data transfer channel.

Figure 9:
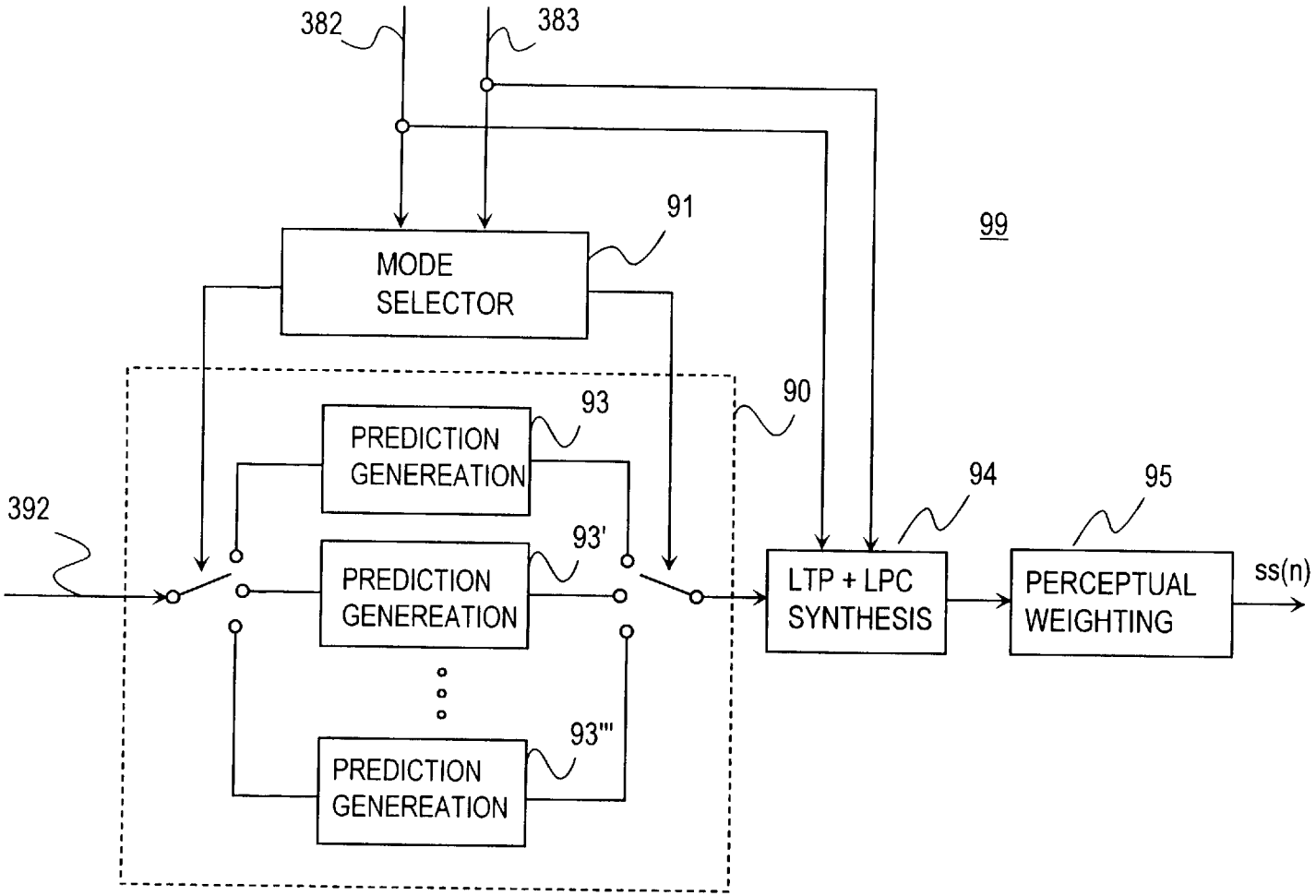
FIG. 9 presents the structure of a speech decoder corresponding to a speech encoder according to the invention.

FIG. 9 presents the structure of variable bit rate speech encoder 99 according to the invention. In generator block 90 variable rate speech parameters 392 received by a decoder are directed to a correct prediction generating block 93-93''' controlled by signals 382 and 383. Signals 382 and 383 are also transferred to LTP+LPC-synthesis block 94. Thus signals 282 and 284 define which speech encoding mode is applied to speech parameter bits 392 received from the data transfer channel.

The correct decoding mode is selected by mode selector 91. The selected prediction generating block 93-93''' transfers the speech parameter bits (excitation vector 61-61''' generated by itself, LTP- and LPC-parameters it has received from the encoder and eventual other speech encoding parameters) to LTP+LPC-synthesis block 94, in which the actual speech synthesizing is performed in the way characteristic of the decoding mode defined by signals 382 and 383. Finally, the signal obtained is filtered as required using weighting filter 95 in order to have desired tone of voice. Synthesized speech signal ss(n) is obtained in the decoder output.

Figure 10:
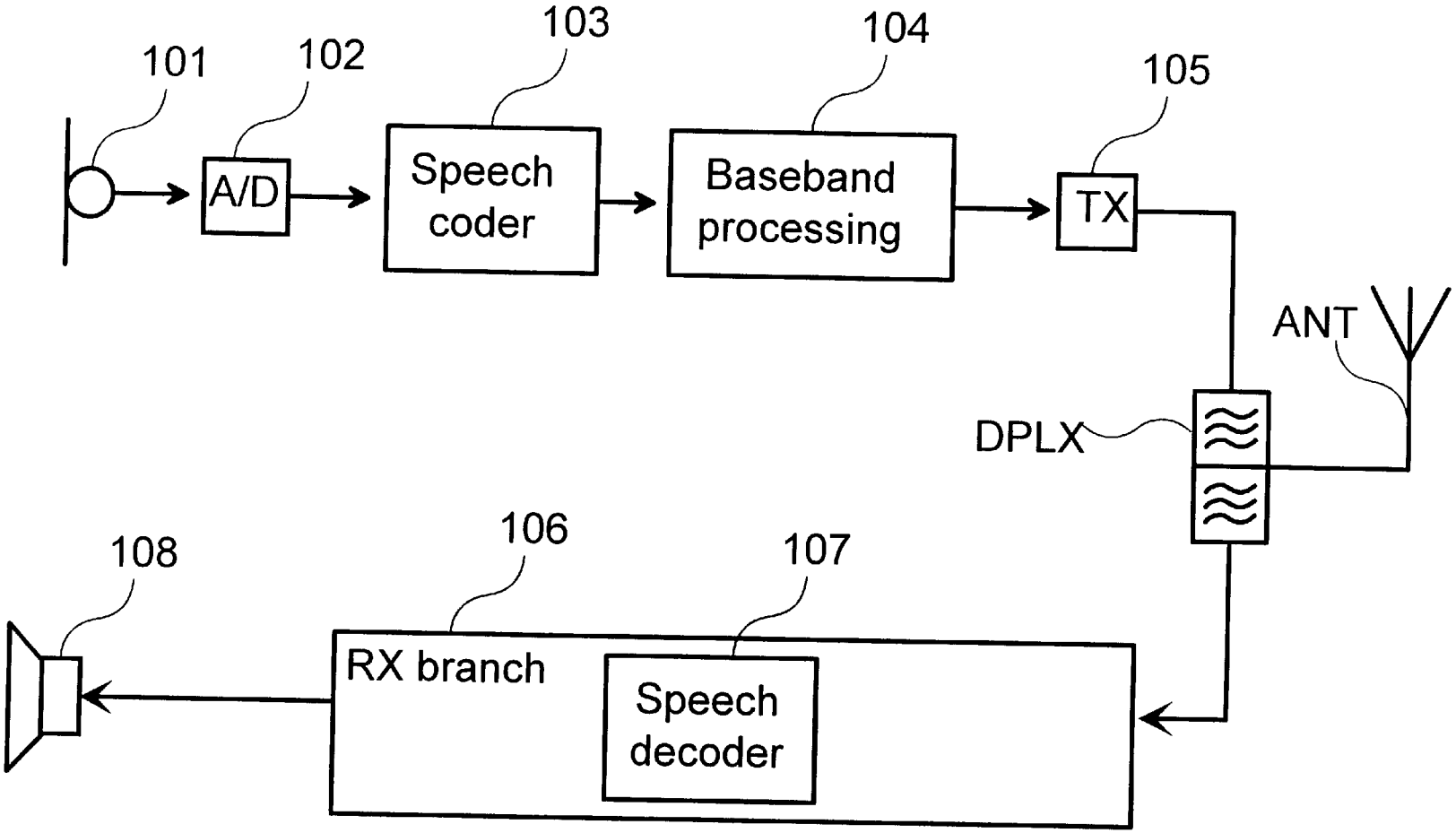
FIG. 10 presents a mobile station utilizing a speech encoder according to the invention and FIG. 11 presents a telecommunication system according to the invention.

FIG. 10 presents a mobile station according to the invention, in which a speech codec according to the invention is used. A speech signal to be transmitted coming from microphone 101 is sampled in A/D-converter 102, and speech encoded in speech encoder 103, after which processing of basic frequency signal is performed in block 104, for example channel encoding, interleaving, as it is known in prior art. After this the signal is converted into radio frequency and transmitted by transmitter 105 using duplex-filter DPLX and antenna ANT. At receiving, the prior known functions of reception branch are performed to the speech received, such as speech decoding in block 107 explained in connection with FIG. 9, and the speech is reproduced using loudspeaker 108.

Figure 11:
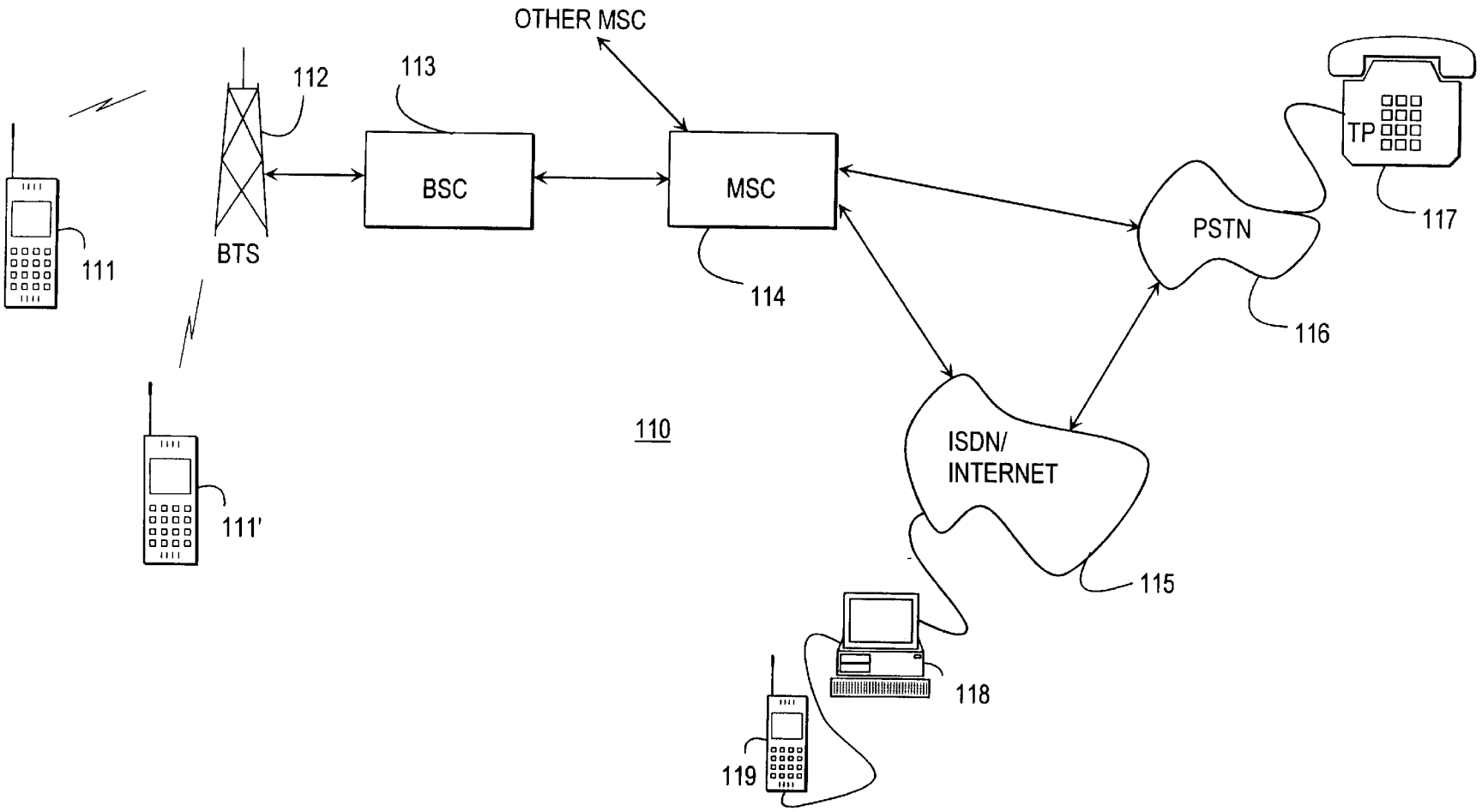

FIG. 11 presents telecommunication system 110 according to the invention, comprising mobile stations 111 and 111', base station 112 (BTS, Base Transceiver Station), base station controller 113, (Base Station Controller), mobile communication switching centre (MSC, Mobile Switching Centre), telecommunication networks 115 and 116, and user terminals 117 and 118 connected to them directly or over a terminal device (for example computer 118). in information transfer system 110 according to the invention mobile stations and other user terminals 117, 118 and 119 are interconnected over telecommunication networks 115 and 116 and they use for data transfer the speech encoding system presented in connection with FIGS. 3, 4, 5A to 5C, and 6 to 9. A telecommunication system according to the invention is efficient because it is capable of transferring speech between mobile stations 111, 111''' and other user terminals 117, 118 and 119, using low average data transfer capacity. This is particularly preferable in connection with mobile stations 111, 111''' using radio connection, but for example when computer 118 is equipped with a separate microphone and a loudspeaker (not shown in the figure), using the speech encoding method according to the invention is an efficient way to avoid unnecessary loading of the network when for example speech is transferred in packet-format over Internet-network.

This has been a presentation of the realization of the invention and some of its embodiments using examples. It is evident to a person skilled in the art that the invention is not limited to the details of the above presented embodiments and that the invention can be realized also in other form without deviating from the characteristics of the present invention. The above presented examples should be regarded as illustrating, not as limiting. Thus the possibilities of realizing and using the invention are limited only by enclosed patent claims. Thus the various embodiments of the invention defined by the claims, including equivalent embodiments, are included in the scope of the invention.

I claim:

1. A speech encoding method for variable-rate encoding a speech signal, comprising the steps of:

a speech signal is divided into speech frames for speech encoding by frames, a first analysis is made for a divided speech frame in order to form a first product, comprising a number of first prediction parameters for modeling the divided speech frame in a first interval, a second analysis is made for the divided speech frame in order to form a second product, comprising a number of second prediction parameters for modeling the divided speech frame in a second interval, and said first and second prediction parameters are presented in digital form, wherein based upon the first and the second products obtained in the first analysis and the second analysis, the number of bits used for presenting one of the following parameters is determined: the first prediction parameters, the second prediction parameters and a combination of them, and the speech signal is encoded by a bit stream comprising a determined number of bits representing said first and said second prediction parameters.

2. A speech encoding method according to claim 1, wherein said first analysis is a short-term LPC-analysis and said second analysis is a long-term LTP-analysis.

3. A speech encoding method according to claim 1, wherein the second prediction parameters modelling the examined speech frame comprise an excitation vector, said first product and second product comprise LPC-parameters modelling the speech frame examined in the first time slot, and an LTP-analysis residual signal modelling the examined speech frame in the second time slot, and that the number of bits used for presenting said excitation vector used for modelling the examined speech frame is determined based upon said LPC-parameters and LTP-analysis residual signal.

4. A speech encoding method according to claim 1, wherein said second prediction parameters comprise an LTP-pitch lag term, an analysis/synthesis filter is used in the LPC-analysis, an open loop with a gain factor is used in the LTP-analysis a model order (m) of the analysis/synthesis filter is used in the LPC-analysis is determined prior to determining the number of bits used for presenting the first and the second prediction parameters, the open loop gain factor is determined in the LTP-analysis prior to determining the number of bits used for presenting the first and second prediction parameters, and the accuracy used for calculating said LPC-pitch lag term used in modelling the examined speech frame is determined based upon said model order (m) and open loop gain factor.

5. A speech encoding method according to claim 4, wherein when determining said second prediction parameters, closed loop LTP-analysis is used in order to determine the LTP-pitch lag term with a higher accuracy.

6. A telecommunication system comprising communication means such as mobile stations, base stations, base station controllers, mobile communication switching centers, telecommunication networks and terminal devices for establishing a telecommunication connection and transferring information between said communication means, said communication means comprise a speech encoder operative with a variable rate of coding, which said speech encoder further comprises means for dividing a speech signal into speech frames for encoding by frames, means for performing a first analysis to a divided speech frame in order to form a first product, which first product comprises prediction parameters modeling the divided speech frame in a first interval, means for performing a second analysis to the divided speech frame in order to form a second product which second product comprises prediction parameters modeling the divided speech frame in a second interval, and means for outputting a coded speech signal by presenting the first and the second prediction parameters in a digital form, wherein said speech encoder further comprises means for analyzing the performance of the first analysis and the second analysis, based upon the first product and the second product, and that said performance analyzing means have been arranged to determine the number of bits used for presenting one of the following parameters: the first prediction parameters, the second prediction parameters, and a combination of them.

7. A communication device comprising means for transferring speech and a speech encoder for speech encoding, which speech encoder is operative with a variable rate of coding and comprises means for dividing a speech signal into speech frames for speech encoding by frames, means for performing a first analysis to a divided speech frame in order to form a first product, which first product comprises first prediction parameters modeling the divided speech frame in a first interval, means for performing a second analysis to the divided speech frame in order to form a second product, which second product comprises second prediction parameters modeling the divided speech frame in a second interval, and means for outputting a coded speech signal by presenting the first and the second prediction parameters in a digital form, wherein said speech encoder further comprises means for analyzing the performance of the first analysis and the second analysis of the speech encoder based upon the first product and the second product, and that said performance analyzing means have been arranged to determine the number of bits used for presenting one of the following parameters: the first prediction parameters, the second prediction parameters and a combination of them.

8. A speech encoder operative with a variable rate of coding, comprising:

means for dividing a speech signal into speech frames for speech encoding by frames, means for performing a first analysis to a divided speech frame in order to form a first product, which first product comprises first prediction parameters modeling the divided speech frame in a first interval, means for performing a second analysis to the divided speech frame in order to form a second product, which second product comprises second prediction parameters modeling the divided speech frame in a second interval, and means for outputting a coded speech signal by presenting the first and the second prediction parameters in a digital form, wherein said speech encoder further comprises means for analyzing the performance of the first analysis and the second analysis of the speech encoder based upon the first product and the second product, and that said performance analyzing means have been arranged to determine the number of bits used for presenting one of the following parameters: the first prediction parameters, the second prediction parameters and a combination of them.

9. A speech encoder operative with a variable rate of coding, comprising:

generating means for outputting a coded speech signal, and means for receiving speech from a telecommunication connection in form of speech parameters, which speech parameters comprise first prediction parameters for modeling speech in a first interval and second prediction parameters for modeling speech in a second interval, wherein said generating means comprise a mode selector, said speech parameters comprise information parameters, said mode selector has been arranged to select a correct speech decoding mode for the first prediction parameters and the second prediction parameters based upon said information parameters.

* * * * *